US007863507B2

(12) United States Patent
Ayers

(10) Patent No.: US 7,863,507 B2
(45) Date of Patent: Jan. 4, 2011

(54) SEMI-HOLLOW BODY FOR STRINGED INSTRUMENTS

(76) Inventor: Jeffrey L. Ayers, E24270 Justice La., Land O'Lakes, WI (US) 54540

( * ) Notice: Subject to any disclaimer, the term of this patent is extended or adjusted under 35 U.S.C. 154(b) by 0 days.

(21) Appl. No.: 12/585,396

(22) Filed: Sep. 14, 2009

(65) Prior Publication Data

US 2010/0101396 A1 Apr. 29, 2010

Related U.S. Application Data

(60) Provisional application No. 61/193,078, filed on Oct. 27, 2008.

(51) Int. Cl.
*G10D 1/08* (2006.01)

(52) U.S. Cl. ..... 84/293

(58) Field of Classification Search ..... 84/267, 84/290, 293

See application file for complete search history.

(56) References Cited

U.S. PATENT DOCUMENTS

| | | | | |
|---|---|---|---|---|
| 1,778,304 | A | 10/1930 | Zauner | |
| 3,685,385 | A | 8/1972 | Rendell | |
| 4,741,238 | A | 5/1988 | Carriveau | |
| 4,989,491 | A | 2/1991 | Baggs | |
| 6,359,208 | B1 | 3/2002 | Farnell, Jr. | |
| D565,093 | S | 3/2008 | Chan | |
| 2004/0231487 | A1* | 11/2004 | Jagmin | 84/291 |
| 2005/0076763 | A1 | 4/2005 | Langeman | |
| 2008/0105101 | A1 | 5/2008 | Eldring | |
| 2008/0202310 | A1 | 8/2008 | Coke | |

FOREIGN PATENT DOCUMENTS

| | | | |
|---|---|---|---|
| GB | 2 045 993 | A | 11/1980 |

OTHER PUBLICATIONS http://www.music123.com/Yamaha-RGX-A2-Electric-Guitar-519172-i1150464.Music123, two pages printed from the Internet Aug. 20, 2008.

* cited by examiner

*Primary Examiner*—Kimberly R Lockett
(74) *Attorney, Agent, or Firm*—Richard C. Litman

(57) ABSTRACT

The semi-hollow body for stringed instruments includes a plurality of resonance-enhancing baffle pairs, each resonance-enhancing baffle pair having a bifurcated prong shape, similar to a tuning fork. The resonance-enhancing baffle pairs extend from an interior peripheral area of the instrument body and create various combinations of baffled and un-baffled regions in a resonance chamber of the semi-hollow body. A solid, central core region separates an upper resonance chamber from a lower resonance chamber. Alternatively, individual resonance enhancing baffles shaped like reeds are disposed inside the instrument body. The semi-hollow body for stringed instruments can be adapted for guitars, violins, mandolins, ukuleles, or the like, and provides a rich, resonant tone to the instrument while avoiding acoustic feedback problems associated with hollow body instruments. Front and back plates cover front and back portions of the body to give it a solid body look and feel.

18 Claims, 6 Drawing Sheets

SEMI-HOLLOW BODY FOR STRINGED INSTRUMENTS

CROSS-REFERENCE TO RELATED APPLICATION

This application claims the benefit of U.S. Provisional Patent Application Ser. No. 61/193,078, filed Oct. 27, 2008.

BACKGROUND OF THE INVENTION

1. Field of the Invention

The present invention relates generally to stringed musical instruments, and more specifically, to a semi-hollow body for stringed instruments, including electric guitars.

2. Description of the Related Art

String instruments are centuries old. Such instruments typically use a sound box, fretted neck and strings stretched taunt across or over the sound box whereby strumming or plucking the strings causes them to vibrate and create a sound. Depressing a string against the fretted neck changes the effective length of the string, which in turn changes the frequency at which the string vibrates when plucked. One type of such a string instrument is a guitar. Today's guitars create sound either mechanically or electronically, forming guitar categories that include acoustic, using mechanical amplification, electric, using electronic amplification, or some combination thereof.

With an acoustic guitar, plucking the strings causes vibration of a soundboard. The soundboard produces sound by resonance. Specifically, the soundboard transmits the vibrations of the strings to the air. In addition, the body of the guitar forms a resonating chamber that further shapes and projects the sound. With electric guitars, transducers, known as pickups, convert string vibration to an electronic signal wherein the electronic signal is routed to an amplifier and then to a speaker.

One drawback of an electric guitar constructed with a hollow body is a resultant uncontrolled resonance which produces feedback when the amplified sound waves from the speaker induce intensified resonant vibrations in the top plate or body of the guitar consequently increasing the amplitude of the original string vibration, typically at one or more of the resonant harmonic frequencies of the guitar body. Accordingly, in an attempt to control feedback problems occurring in an electric hollow body guitar, various guitar body structures have been developed, including solid-body guitars.

Although tending to be very resistant to feedback, a disadvantage of a solid-body electric guitar is that the characteristics of the sound produced generally lacks the resonant complexity of a hollow-body guitar. An advantage of a solid-body guitar is that a vibrating string can be allowed to sustain its vibration for a longer period of time since less of the string vibration energy is transferred into creating resonant vibration of the guitar body.

While typically having a solid body to prevent feedback problems, electric guitars may also have a semi-hollow guitar body. One advantage of a semi-hollow guitar body is the capability to produce complex resonant tones more characteristic of hollow-body guitars while still limiting susceptibility to feedback. Countless body structures have been designed to control body structure vibration and correspondingly feedback occurring during amplified guitar use while still providing some measure of resonance. Yet there remains a need for a guitar body structure that better optimizes resonant characteristics, provides improved capability to sustain notes, and minimizes susceptibility to feedback while achieving a distinct guitar sound.

Thus, a semi-hollow body for stringed instruments solving the aforementioned problems is desired.

SUMMARY OF THE INVENTION

In a first embodiment, the semi-hollow body for stringed instruments includes a plurality of resonance-enhancing baffle pairs extending from an inner peripheral wall of upper and lower acoustical chambers, each resonance-enhancing baffle pair having a tuning fork appearance. In a second embodiment, the semi-hollow body for stringed instruments includes a plurality of individual resonance-enhancing baffles extending from an inner peripheral wall of upper and lower acoustical chambers, each resonance baffle having a reed appearance. The semi-hollow body for stringed instruments can be adapted for guitars, violins, mandolins, ukuleles, or the like, and provides a rich, resonant tone to the instrument while mitigating acoustic feedback problems associated with hollow body instruments.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
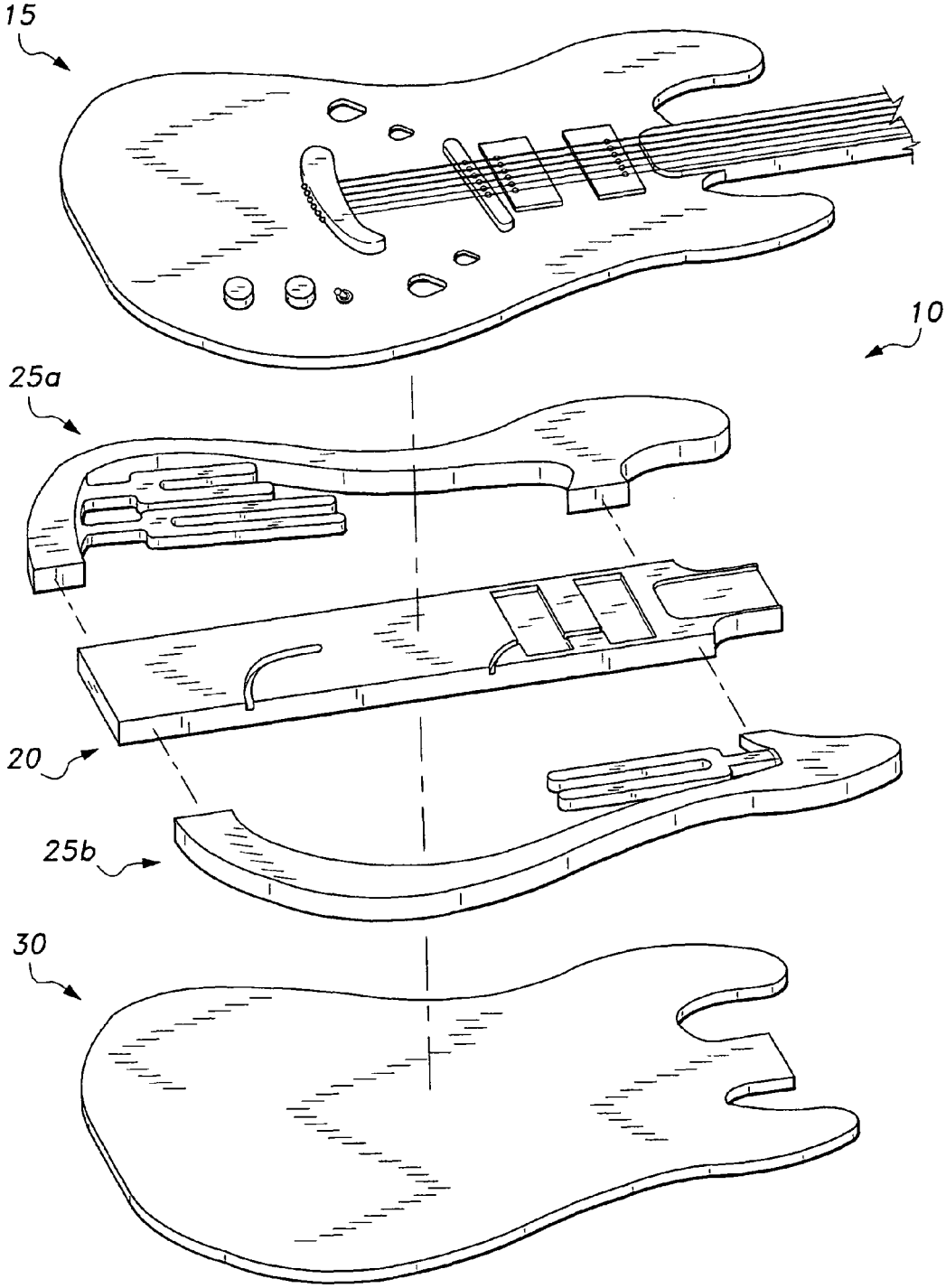
FIG. 1 is an exploded, perspective view of a first embodiment of a semi-hollow body for stringed instruments according to the present invention.

As shown in FIGS. 1-4, in a first embodiment, the semi-hollow body 10 for stringed instruments may include a plurality of elongate resonance-enhancing baffle pairs 205, each resonance-enhancing baffle pair 205 having a bifurcated prong shape resembling a tuning fork in appearance and acoustic function. The resonance-enhancing baffle pairs 205 are disposed within a peripheral area of the instrument body (within a space defined by the wings 25*a*, 25*b* and the central core 20) and create various combinations of baffled regions and hollow, un-baffled regions in a resonance chamber of the semi-hollow body 10. The solid, central core region 20 separates an upper resonance chamber inside of top body portion wing 25*a* from a lower resonance chamber inside of bottom body portion wing 25*b*. During manufacture, the wings 25*a* and 25*b* are glued onto the central core 20.

Figure 5:
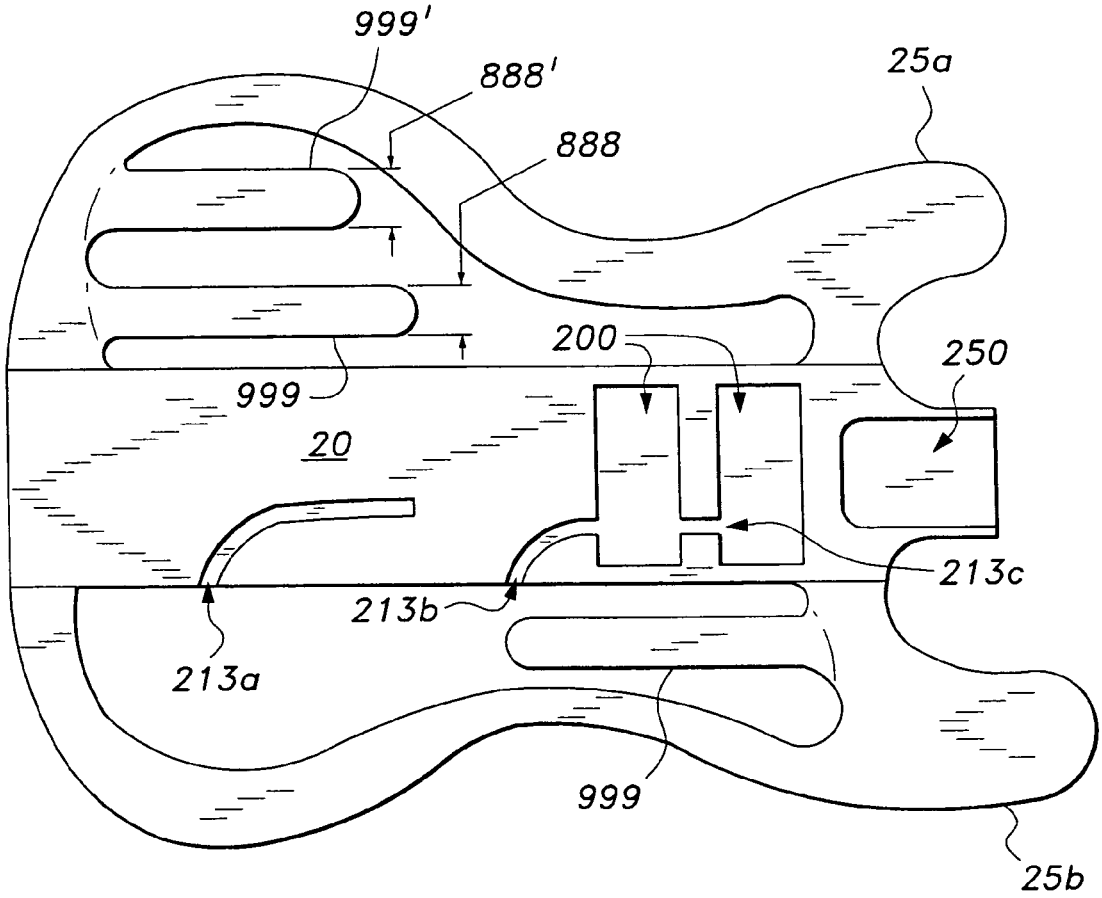
FIG. 5 is a front view of an alternative embodiment of a semi-hollow body for stringed instruments according to the present invention.
Figure 6:
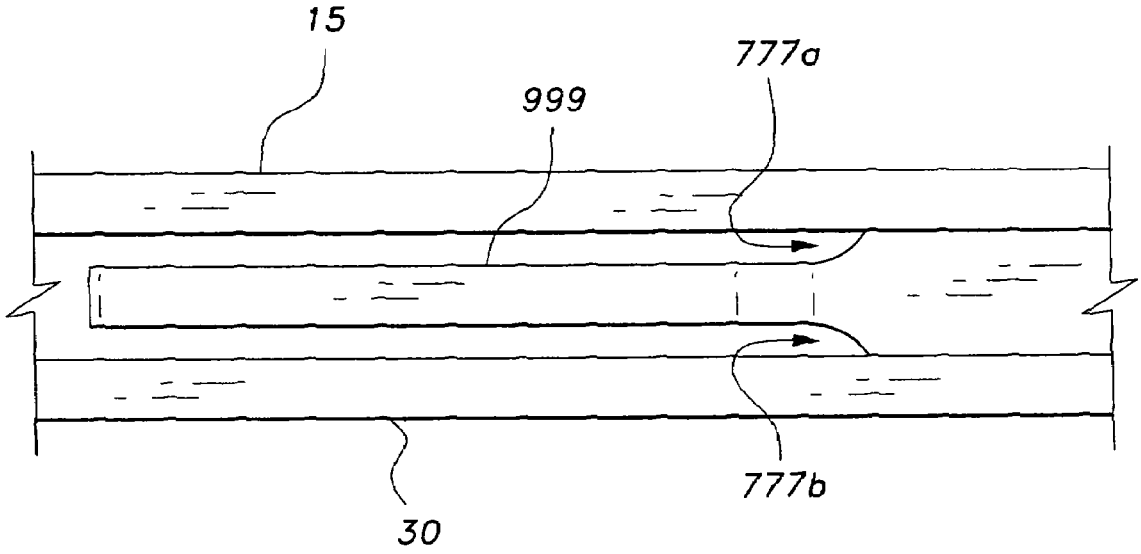
FIG. 6 is a partial side view of the semi-hollow body for stringed instruments of FIG. 5.

Alternatively, as shown in FIGS. 5 and 6, individual elongate resonance-enhancing baffles 999 that are shaped and acoustically function like reeds are disposed inside the instrument body. The arrangement of reed-like resonance-enhancing baffles 999 or tuning fork-styled resonance-enhancing baffles 205 greatly enhances the resonance and sustain in an electric guitar. Each reed structure 999 or tuning fork structure 205 within the guitar body vibrates and keeps a note sustained. Each resonating structure 999, 205 can have a different lateral thickness for a designed response to high, intermediate, or low tones, since the resonant frequency can be adjusted by either changing the mass and/or length of the resonating structures 999, 205.

Figure 2:
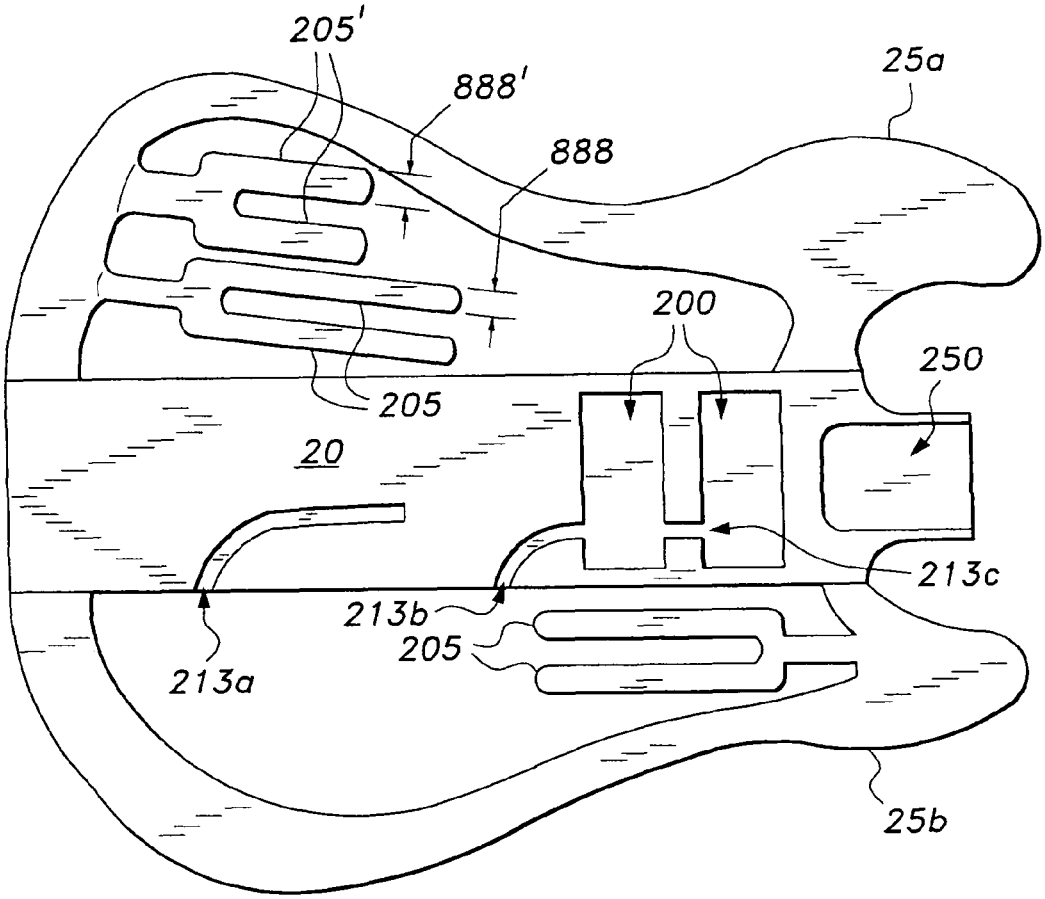
FIG. 2 is a front view of the central core and the upper and lower resonant cavities of the semi-hollow body for stringed instruments of FIG. 1.
Figure 3:
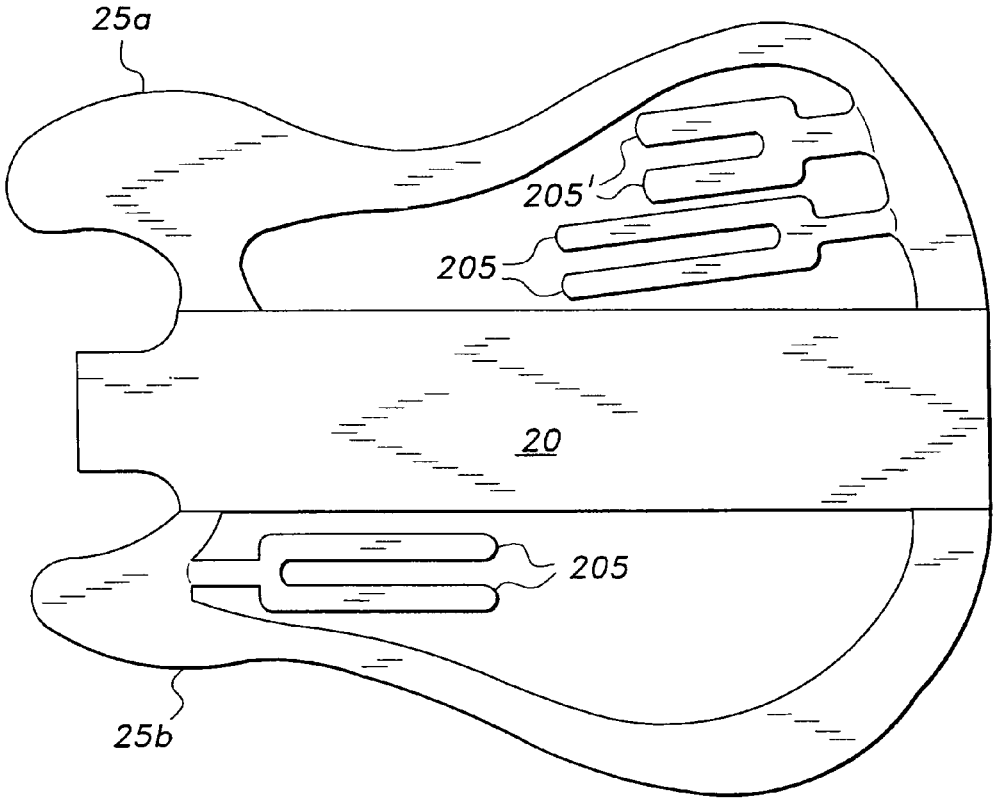
FIG. 3 is a rear view of the central core and the upper and lower resonant cavities of the semi-hollow body for stringed instruments of FIG. 1.
Figure 4:
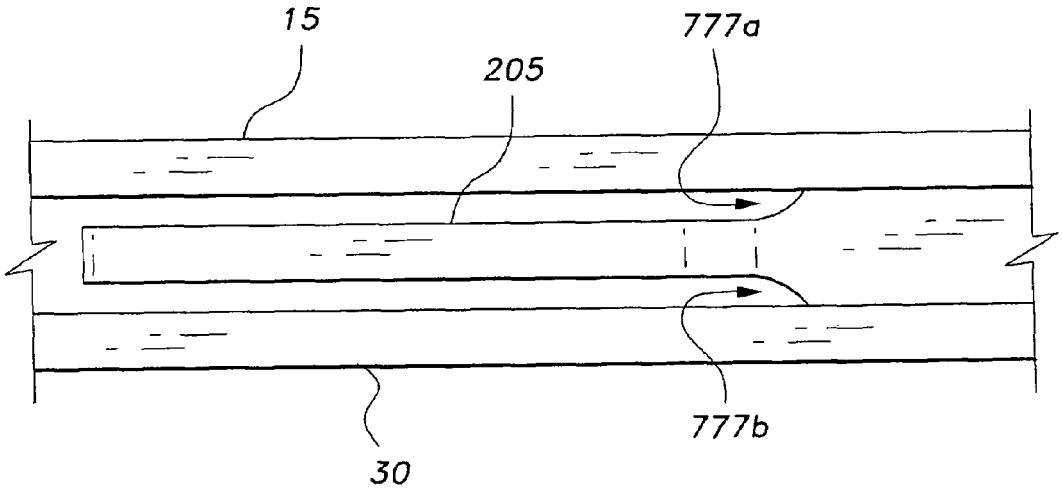
FIG. 4 is a partial side view of the semi-hollow body for stringed instruments of FIG. 1.

For example, adding mass, i.e., lateral thickness 888, without changing the length lowers the resonant frequency. As shown in FIG. 2, resonating member 205' has a lateral thickness 888' that is greater than that of resonating member 205, which has a lateral thickness 888. Similarly, as shown in FIG. 5, resonating member 999' has a lateral thickness 888' that is greater than that of resonating member 999, which has a lateral thickness 888. Geometric parameters, such as location, length and thickness of the resonating structures, e.g., resonance baffles 999, 999' and 205, 205', can be programmed into a computer numerical control (CNC) milling machine tool for consistent manufacture of a stringed instrument using the inventive semi-hollow body 10.

Longitudinal thickness of reed members 999 or tuning fork members 205 changes inwardly as the members extend longitudinally from the peripheral portion of wings 25*a*, 25*b* to form upper tapered region 777*a* and lower tapered region 777*b*. The semi-hollow body for stringed instruments can be adapted for guitars, violins, mandolins, ukuleles, or the like, and provides a rich, resonant tone to the instrument while avoiding acoustic feedback problems associated with hollow body instruments. Front plate 15 and back plate 30 cover front and back portions of the body to give it a solid body look and feel.

Stringed instrument hardware is attached to the semi hollow body 10. For example, in the embodiment shown, electric guitar hardware (including bridge, electronic controls, magnetic pickups, guitar neck, and the like) is attached to the semi-hollow body 10. As shown in FIG. 2, the core 20 has cable grooves 213*a*, 213*b*, and 213*c* to accommodate wiring for an electric guitar. Pickup cutouts 200 accommodate magnetic pickups, or the like. Guitar neck cutout 250 accommodates a guitar neck attached to front plate 15, shown in FIG. 1. Guitar strings are then attached to complete the construction of an electric guitar utilizing the semi-hollow body 10.

It is to be understood that the present invention is not limited to the embodiments described above, but encompasses any and all embodiments within the scope of the following claims.

I claim:

1. A semi-hollow body for stringed instrument, comprising:

a central core having upper and lower longitudinal sidewalls, a top portion, and a bottom portion;

an upper resonance chamber wing;

a lower resonance chamber wing;

elongate resonating members extending inward from a peripheral region of at least one of the upper and lower resonance chamber wings, the upper and lower resonance chamber wings being attached to the central core along the upper and lower longitudinal sidewalls of the central core; and top and bottom covers attached to the top and bottom portions, respectively, of the central core, resonating portions of the elongate resonating members being suspended between the top and bottom covers.

2. The semi-hollow body for stringed instrument according to claim 1, wherein the stringed instrument is an electric guitar, the semi-hollow body being adapted for attachment to a neck portion of the electric guitar.

3. The semi-hollow body for stringed instrument according to claim 1, wherein at least one of the elongate members terminates in bifurcated prongs.

4. The semi-hollow body for stringed instrument according to claim 1, wherein at least one of the elongate members is arcuate.

5. The semi-hollow body for stringed instrument according to claim 1, wherein the central core has at least one cavity extending through the core.

6. The semi-hollow body for stringed instrument according to claim 2, wherein said top cover is adapted for supporting electric guitar hardware, including pickup and string attachments.

7. The semi-hollow body for stringed instrument according to claim 6, wherein the central core is adapted for housing the guitar pickup and guitar hardware.

8. The semi-hollow body for stringed instrument according to claim 1, wherein the elongate members have varying mass, thereby creating a specific pattern of resonance within the instrument.

9. The semi-hollow body for stringed instrument according to claim 1, wherein the elongate members have varying lengths, thereby creating a specific pattern of resonance within the instrument.

10. A guitar, comprising:

a neck;

a semi-hollow body connected to the neck;

a core defining a central portion of the semi-hollow body, the core having upper and lower longitudinal sidewalls, a top portion, and a bottom portion;

an upper resonance chamber wing;

a lower resonance chamber wing;

elongate resonating members extending inward from a peripheral region of at least one of the upper and lower resonance chamber wings, the upper and lower resonance chamber wings being attached to the central core along the upper and lower longitudinal sidewalls of the central core; and top and bottom covers attached to the top and bottom portions, respectively, of the central core, resonating portions of the elongate resonating members being suspended between the top and bottom covers.

11. The guitar according to claim 10, wherein said top cover is adapted for supporting guitar hardware, including string attachments.

12. The guitar according to claim 11, wherein said top cover is adapted for supporting electric guitar pickup and control hardware.

13. The guitar according to claim 12, wherein said central core is adapted for housing the guitar pickup and guitar hardware.

14. The guitar according to claim 10, wherein at least one of the elongate members terminates in bifurcated prongs.

15. The guitar according to claim 10, wherein at least one of the elongate members is arcuate.

16. The guitar according to claim 10, wherein the central core has at least one cavity extending through the core.

17. The guitar according to claim 10, wherein the elongate members have varying mass, thereby creating a specific pattern of resonance within the guitar.

18. The guitar according to claim 10, wherein the elongate members have varying lengths, thereby creating a specific pattern of resonance within the guitar.

* * * * *